US011509099B1

(12) United States Patent
Yuan et al.

(10) Patent No.: US 11,509,099 B1
(45) Date of Patent: Nov. 22, 2022

(54) ELECTRIC CONNECTOR STRUCTURE

(71) Applicant: JESS-LINK PRODUCTS CO., LTD., New Taipei (TW)

(72) Inventors: Ming-Yang Yuan, New Taipei (TW); Hu Liu, New Taipei (TW); Chun-Fu Chen, New Taipei (TW); Hsu-Feng Chang, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 31 days.

(21) Appl. No.: 17/362,201

(22) Filed: Jun. 29, 2021

(51) Int. Cl.

| | |
|---|---|
| ***H01R 13/6585*** | (2011.01) |
| ***H01R 13/516*** | (2006.01) |
| ***H01R 24/60*** | (2011.01) |
| ***H01R 13/6583*** | (2011.01) |

(52) U.S. Cl.
CPC ..... *H01R 13/6585* (2013.01); *H01R 13/516* (2013.01); *H01R 13/6583* (2013.01); *H01R 24/60* (2013.01)

(58) Field of Classification Search
CPC ... H01R 13/6585; H01R 13/516; H01R 24/60
USPC ..... 439/607
See application file for complete search history.

(56) References Cited

U.S. PATENT DOCUMENTS

2019/0067872 A1* 2/2019 Cha ..... H01R 13/5219
2019/0089077 A1* 3/2019 Huang ..... H01R 12/716
2019/0097361 A1* 3/2019 Wang ..... H01R 13/6596
2019/0157811 A1* 5/2019 Tada ..... H01R 13/6585
2019/0173238 A1* 6/2019 Ba ..... H01R 13/6585
2019/0288465 A1* 9/2019 Little ..... H01R 12/58
2020/0067243 A1* 2/2020 Su ..... H01R 13/6585
2020/0112128 A1* 4/2020 Liu ..... H01R 13/6585
2020/0112129 A1* 4/2020 Liu ..... H01R 13/502
2020/0119497 A1* 4/2020 Chou ..... H01R 24/64
2020/0136291 A1* 4/2020 Zhao ..... H01R 13/405
2020/0212642 A1* 7/2020 Zhao ..... H01R 43/16
2020/0235515 A1* 7/2020 Tsai ..... H01R 13/426
2020/0274302 A1* 8/2020 Wang ..... H01R 13/6585
2020/0313360 A1* 10/2020 Oosaka ..... H01R 24/60
2020/0412067 A1* 12/2020 Xu ..... H01R 13/5219
2021/0006015 A1* 1/2021 Xu ..... H01R 13/6596
2021/0013682 A1* 1/2021 Zhang ..... H01R 43/16
2021/0091521 A1* 3/2021 Chang ..... H01R 13/6271
2021/0111508 A1* 4/2021 Gu ..... H01R 43/24
(Continued)

*Primary Examiner* — Alexander Gilman
(74) *Attorney, Agent, or Firm* — Chun-Ming Shih; HDLS IPR Services

(57) ABSTRACT

An electric connector includes an insulative body, multiple conductive terminals, a shielding sheet, and a shielding shell. The insulative body includes a base and a tongue. The conductive terminals include an upper row of terminals and a lower row of terminals, which are disposed on an upper side and a lower side of the tongue, respectively. The shielding sheet is embedded in the insulative body and located between the upper row of terminals and the lower row of terminals. Two sides of the shielding sheet are extended with an extending section respectively. A distal end of each extending section is folded back to form an engaging portion. The shielding shell is adapted to sheathes the insulative body. Two sides of the shielding shell are respectively provided with an engaging trough engaged with one of the engaging portions to make the shielding shell contact with the shielding sheet.

10 Claims, 9 Drawing Sheets

(56) References Cited

U.S. PATENT DOCUMENTS

| | | | | |
|---|---|---|---|---|
| 2021/0119384 | A1* | 4/2021 | Kawasaki | H01R 13/5202 |
| 2021/0135410 | A1* | 5/2021 | Zhang | H01R 13/24 |
| 2021/0135411 | A1* | 5/2021 | Mao | H01R 13/6461 |
| 2021/0257789 | A1* | 8/2021 | Chang | H01R 13/6585 |
| 2021/0376534 | A1* | 12/2021 | Kasar | H01R 13/65914 |
| 2021/0384680 | A1* | 12/2021 | Yamazaki | H01R 13/6596 |
| 2021/0399500 | A1* | 12/2021 | Chang | H01R 13/6593 |

* cited by examiner

ELECTRIC CONNECTOR STRUCTURE

BACKGROUND

Technical Field

The invention relates to an electric connector, particularly to an electric connector structure with stable electromagnetic compatibility under high-speed signal transmission.

Related Art

With the flourishing development of technology, the signal transmission between ports of various electronic products is an important issue. The transmission speed has been risen from early 1.5 Mbps of USB 1.0 to 20 Gbps of USB 3.2 in recent year, and is even being increased to 40 Gbps in the USB 4.

In addition, with the trend of compactness of various electronic products, connectors must keep a certain size under the conditions of increasing transmission speed, so the design of the electromagnetic shielding structure for connectors become more difficult. Iron shells of many USB connectors have gaps or slots which cause signal interference. Therefore, how to design a connector with stable electromagnetic compatibility and avoiding signal interference under high-speed transmission is needed to resolve above drawback.

SUMMARY

An object of the disclosure is to provide an electric connector structure with stable electromagnetic compatibility under high-speed transmission.

To accomplish the above object, the disclosure provides an electric connector structure, which includes an insulative body, multiple conductive terminals, a shielding sheet, and a shielding shell. The insulative body includes a base and a tongue extended from the base. The conductive terminals include an upper row of terminals and a lower row of terminals. The upper row of terminals and the lower row of terminals are disposed on an upper side and a lower side of the tongue, respectively. The shielding sheet is embedded in the insulative body and located between the upper row of terminals and the lower row of terminals. Two sides of the shielding sheet are respectively extended with an extending section passing through the insulative body. A distal end of each extending section is folded reversely to form an engaging portion. The shielding shell is adapted to sheathe the insulative body. Two sides of the shielding shell are respectively provided with an engaging trough. Each of the engaging troughs is adapted to sheathe and engage with each of the engaging portion to make the shielding shell contact with the shielding sheet.

The disclosure has following functions. The double-layer engaging portion formed by folding reversely may strengthen the structure to avoid deformation or insufficient engagement. The guiding slant may improve smoothness of inserting the engaging portion into the engaging trough. The protrusions on the top side and the bottom side of the engaging trough make the protrusions and the engaging portion interfere with each other to make the engagement be firm without loosening. The recess may prevent the front of the engaging portion from abutting against the closed end of the engaging trough to affect the assembling accuracy after the engaging portion is inserted. The junction of the shielding shell is located above the tongue to make the shielding shell be free from holes and gaps under the tongue. As a result, the desired electromagnetic shielding effect may be obtained. The outer shielding casing may further shield the junction on the top the shielding shell and a distal end of the insulative body to enhance the electromagnetic shielding effect at the top and the distal end of the insulative body. Each support protrusion may support the electric connector on the printed circuit board to avoid frontward tilting to accomplish a support effect.

In view of this, the inventors have devoted themselves to the above-mentioned related art, researched intensively and cooperated with the application of science to try to solve the above-mentioned problems. Finally, the invention which is reasonable and effective to overcome the above drawbacks is provided.

DETAILED DESCRIPTION

Figure 1:
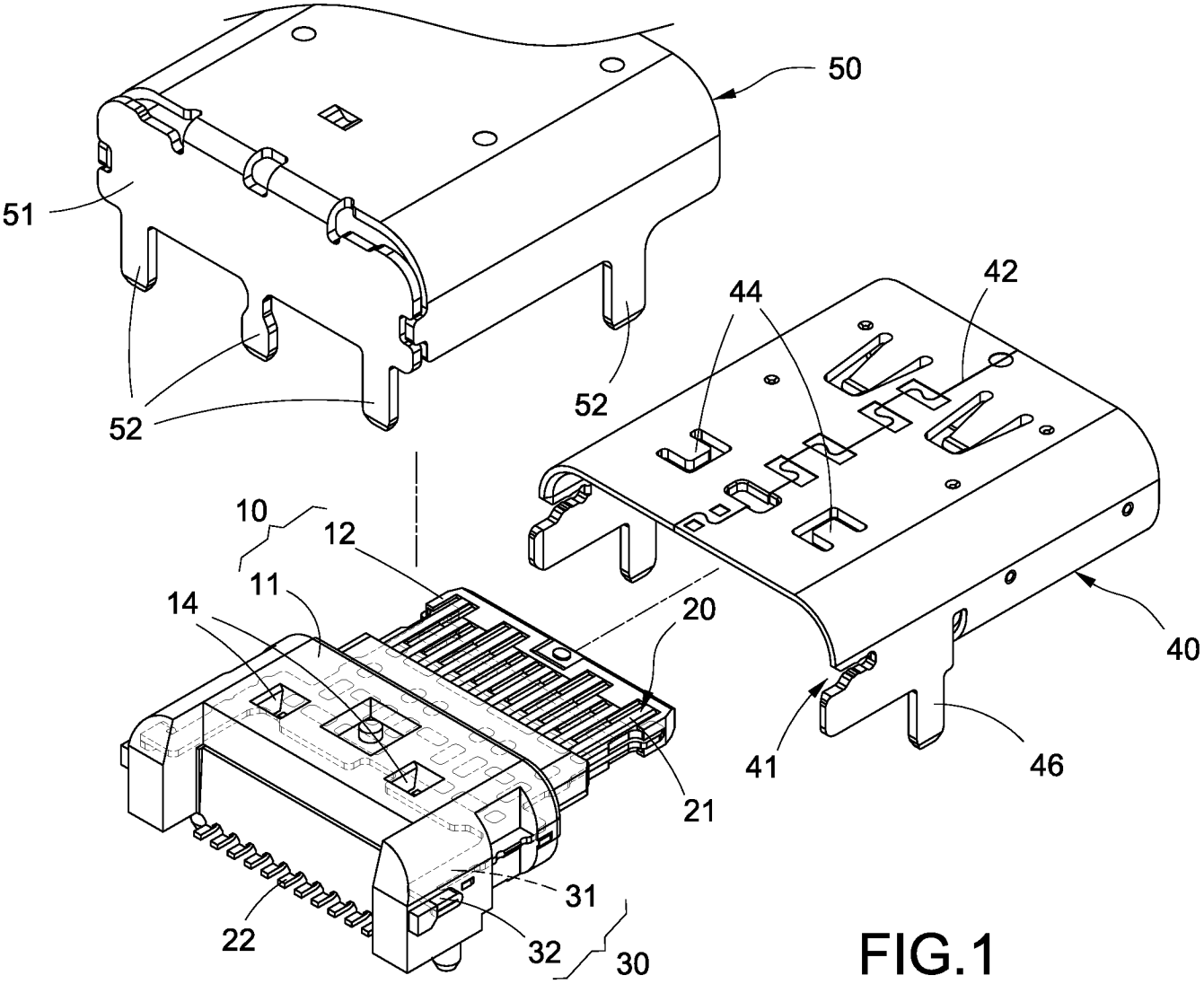
FIG. 1 is an exploded view of the disclosure.

The technical contents of this disclosure will become apparent with the detailed description of embodiments accompanied with the illustration of related drawings as follows. It is intended that the embodiments and drawings disclosed herein are to be considered illustrative rather than restrictive.

The disclosure provides an electric connector structure, as shown in FIGS. 1-4, which includes an insulative body 10, multiple conductive terminals 20, a shielding sheet 30, and a shielding shell 40.

The insulative body 10 is made of plastic or other insulative material and includes a base 11 and a tongue 12 extended from the base 11. The tongue 12 is a flat plate.

The conductive terminals 20 are made of material with desired conductivity, such as copper or alloy thereof. The conductive terminals 20 include an upper row of terminals 21 and a lower row of terminals 22. The upper row of terminals 21 and the lower row of terminals 22 are disposed on an upper side and a lower side of the tongue 12, respectively, such that the tongue 12 may isolate the upper row of terminals 21 and the lower row of terminals 22 to avoid them contacting with each other to influence the signal transmission.

The shielding sheet 30 is a sheet-shaped structure made of metal material, embedded in the insulative body 10 and located between the upper row of terminals 21 and the lower row of terminals 22. The shielding sheet 30 is isolated from the upper row of terminals 21 and the lower row of terminals 22 by the insulative body 10 to avoid direct contact. Therefore, the shielding sheet 30 may serve for electronic shielding to avoid signal interference between the upper row of terminals 21 and the lower row of terminals 22. Two sides of the shielding sheet 30 are respectively extended with an extending section 31 passing through the insulative body 10.

A distal end of each extending section 31 is folded reversely to form an engaging portion 32.

In the embodiment, the engaging portion 32 is a double-layer structure formed by the distal end of the extending section 31 being folded downward and reversely toward a direction away from the tongue 12, but not limited to this. For example, the distal end of the extending section 31 may also be folded upward and reversely toward a direction away from the tongue 12, folded inward and reversely from outside toward the insulative body 10, from the outside or welded to form the double-layer structure of the engaging portion 32.

The shielding shell 40 is made by bending and welding a metal sheet and is of a substantially oval shell. The shielding shell 40 is adapted to sheathe and cover the insulative body 10. Two sides of the shielding shell 40 are respectively provided with an engaging trough 41. Each engaging trough 40 is adapted to sheathe and engage with each engaging portion 32 to make the shielding shell 40 contact with the shielding sheet 30. Therefore, the shielding shell 40 may generate an electromagnetic shielding effect with respect to the upper row of terminals 21 and the lower row of terminals 22. In addition, the engaging portion 32 is formed by the extending section 31 being folded backward, so the double-layer thickness after being folded may increase the structural strength of the engaging portion 32 to avoid excessive deformation or separation due to insufficient engagement when the engaging portion 32 and the engaging trough 41 are engaged.

Figure 5:
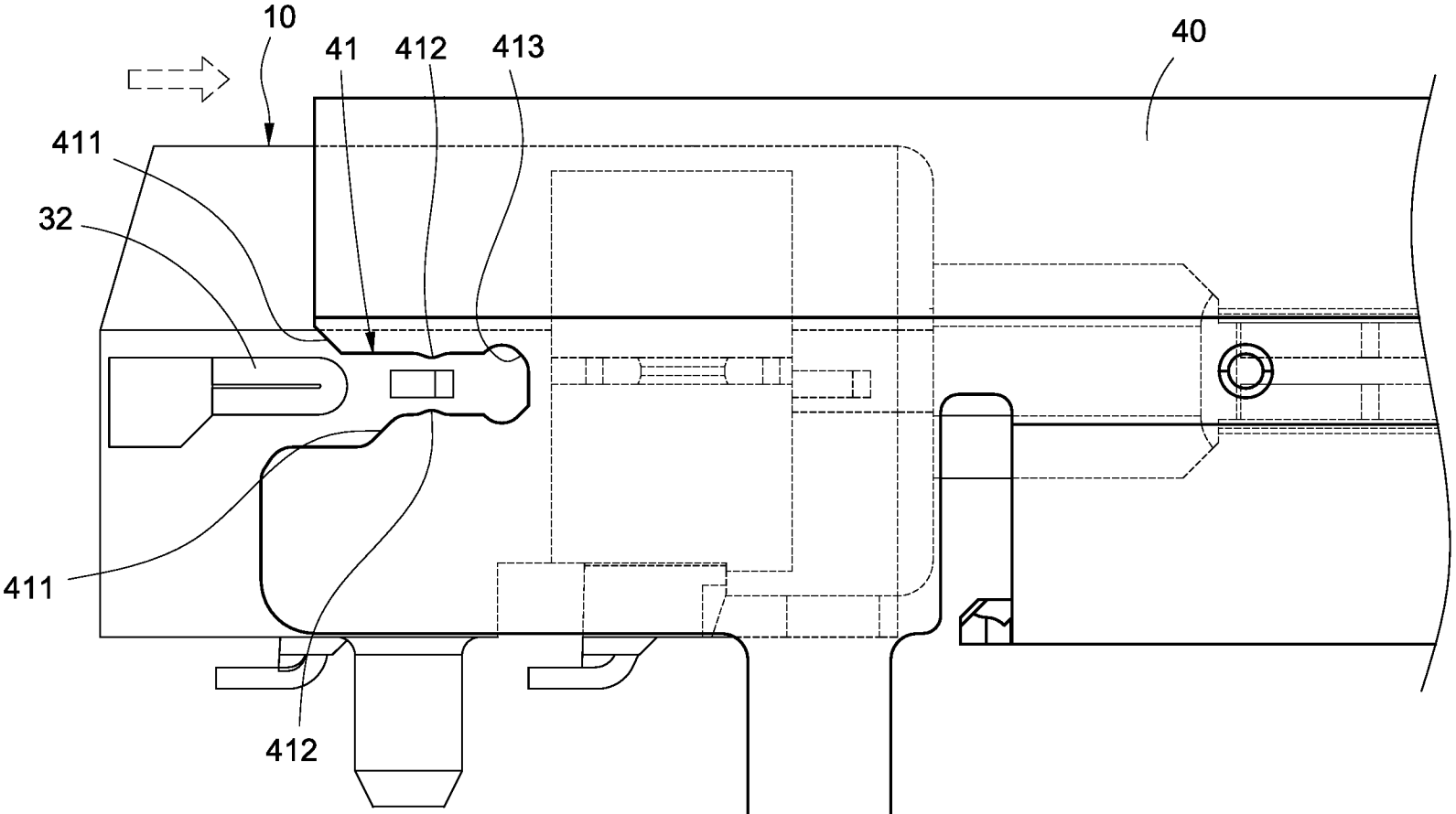
FIGS. 5 and 6 are two schematic views of the disclosure in assembling.

Please refer to FIG. 5. A guiding slant 411 is formed at an opening of each engaging trough 41 to improve smoothness of inserting the engaging portion 32 into the engaging trough 41. The top side and the bottom side of the engaging trough 41 is formed with a protrusion 412 respectively to make the protrusions 412 and the engaging portion 32 interfere with each other when the engaging portion 32 is inserted into the engaging trough 41. This makes the engagement of the engaging portion 32 and the engaging trough 41 be firm without loosening so as to keep the shielding sheet 30 and the shielding shell 40 contacting to each other. Please further refer to FIG. 6. A closed end of the engaging trough 41 is formed with a recess 413. Certain error may occur when the engaging portion 32 is folded reversely, so the recess 413 may prevent the front of the engaging portion 32 from abutting against the closed end of the engaging trough 41 to affect the assembling accuracy after the engaging portion 32 is inserted.

Figure 6:
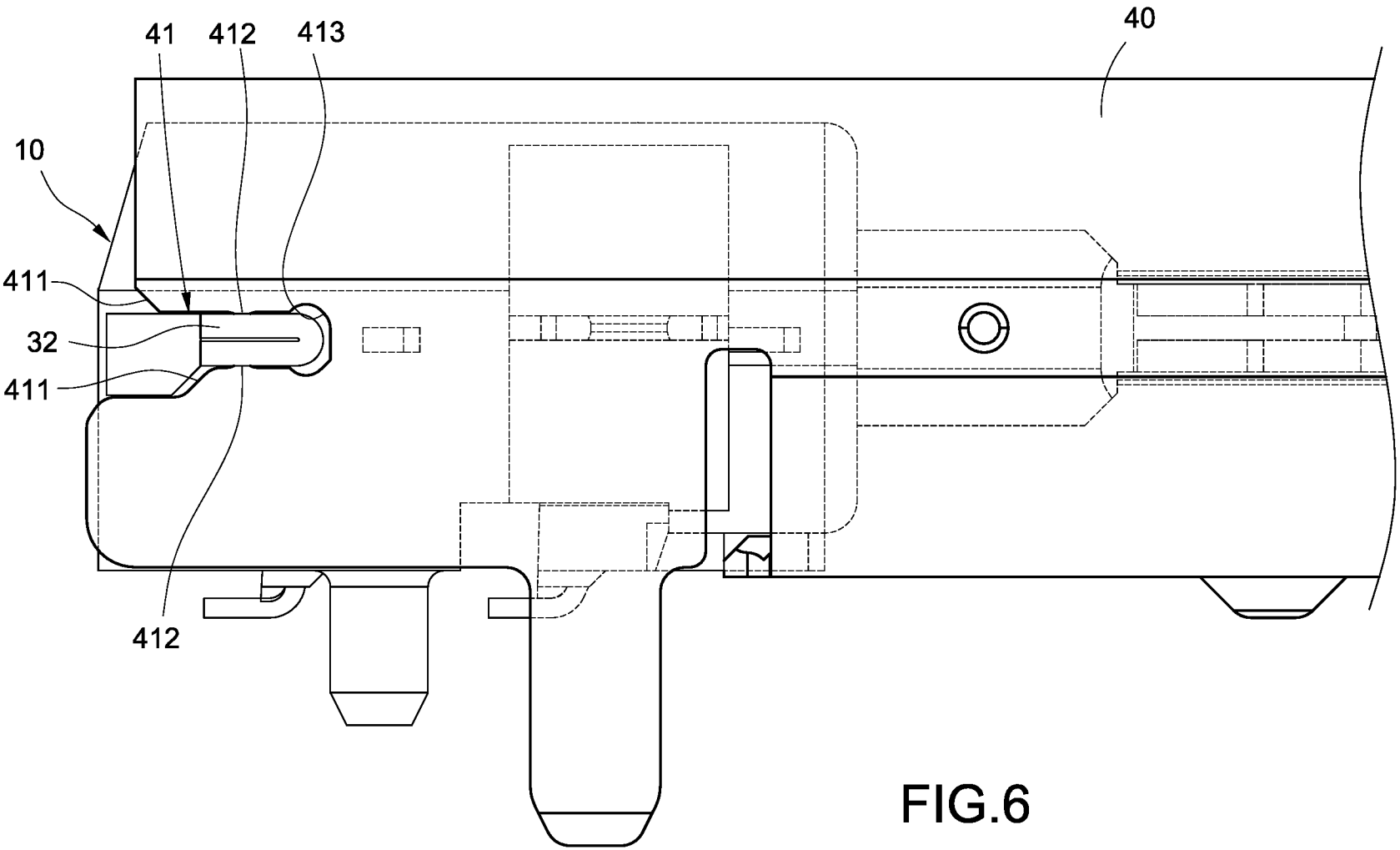

Please refer back to FIGS. 5 and 6 which are two schematic views of the disclosure in assembling. First, the insulative body 10 is sheathed with the shielding shell 40 and the engaging troughs 41 on the two sides are aligned respectively with the engaging portions 32. At this time, the guiding slant 411 at the opening of the engaging trough 41 may be used to guide the engaging portion 32 to be inserted as shown in FIG. 5. Next, the engaging portion 32 is inserted into the engaging trough 41 for engagement. The protrusions 412 may make the engaging portion 32 and the engaging trough 41 closely engage. The recess 413 may prevent the front of the engaging portion 32 from abutting against the shielding shell 40 to cause assembling errors as shown in FIG. 6.

Please refer back to FIGS. 1 and 2. In the shielding shell 40 of the electric connector of the disclosure, two sides of a metal sheet are upward bent to form a shell with a junction 42. Thus, the junction 42 of the shielding shell 40 is located above the tongue 12 to make the shielding shell 40 under the tongue 12 be free from forming holes and gaps. As a result, the desired electromagnetic shielding effect may be obtained.

Also, the electric connector of the disclosure further includes an outer shielding casing 50. The outer shielding casing 50 is made by bending a metal sheet and is of an inverted-U shape. The outer shielding casing 50 covers the shielding shell 40 from the top and shields the junction 42. The tail of the outer shielding casing 50 is bent to form a rear cover 51 for shielding an end of the insulative body 10 located away from the tongue 12. This may further shield the junction 42 at the top the shielding shell 40 and a distal end of the insulative body 10 to enhance the electromagnetic shielding effect at the top and the distal end of the insulative body 10.

In the embodiment, each engaging trough 41 is formed on two sides of the shielding shell 40, but not limit to this. For example, each engaging trough 41 may be formed on two sides of the outer shielding casing 50 and is separately engaged with the engaging portions 32 of the shielding sheet 30 to accomplish the electromagnetic shielding effect. Either the engaging portion 32 being formed on the shielding shell 40 or the outer shielding casing 50, they are within the protection scope of the disclosure.

Figure 2:
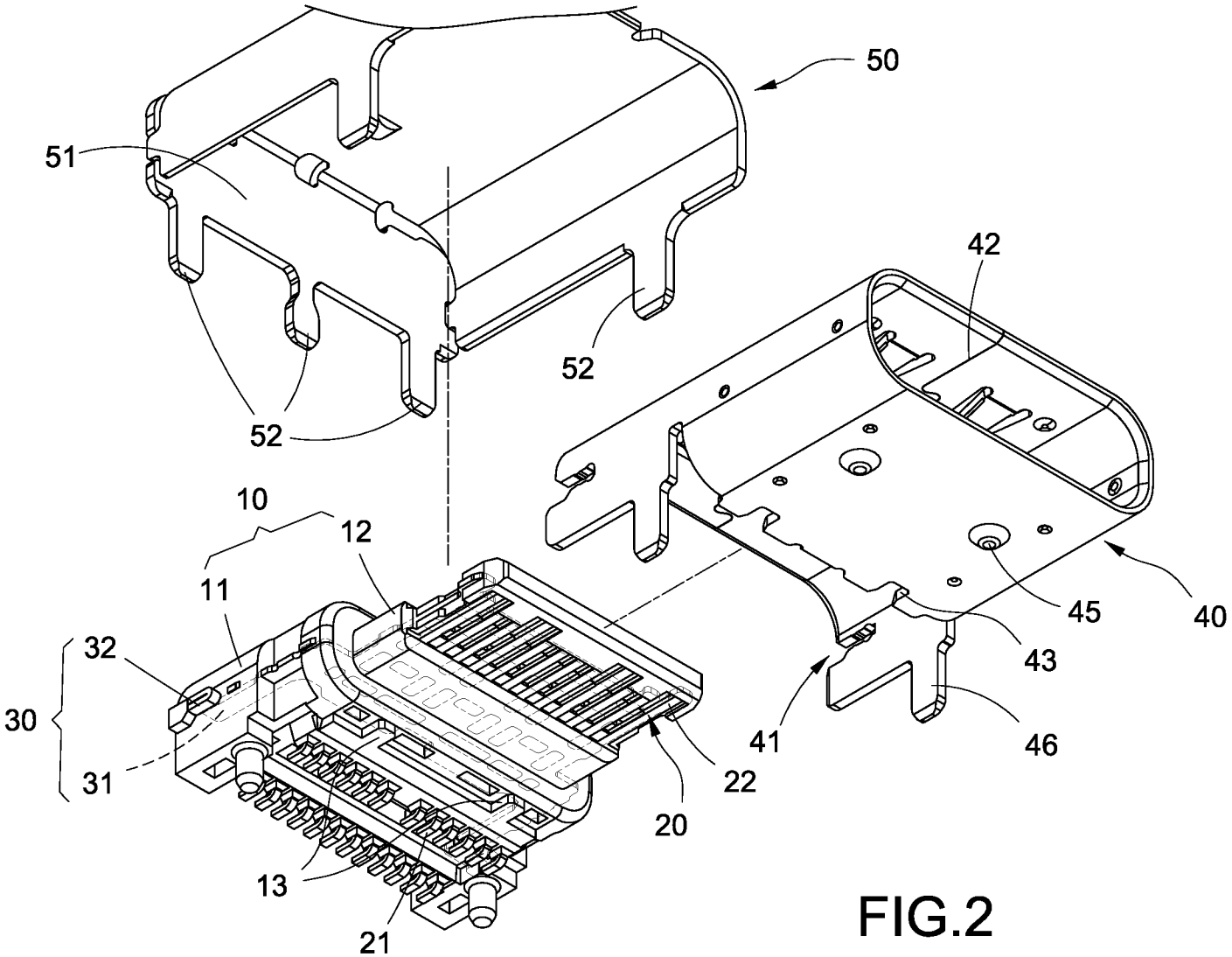
FIG. 2 is another exploded view of the disclosure.
Figure 3:
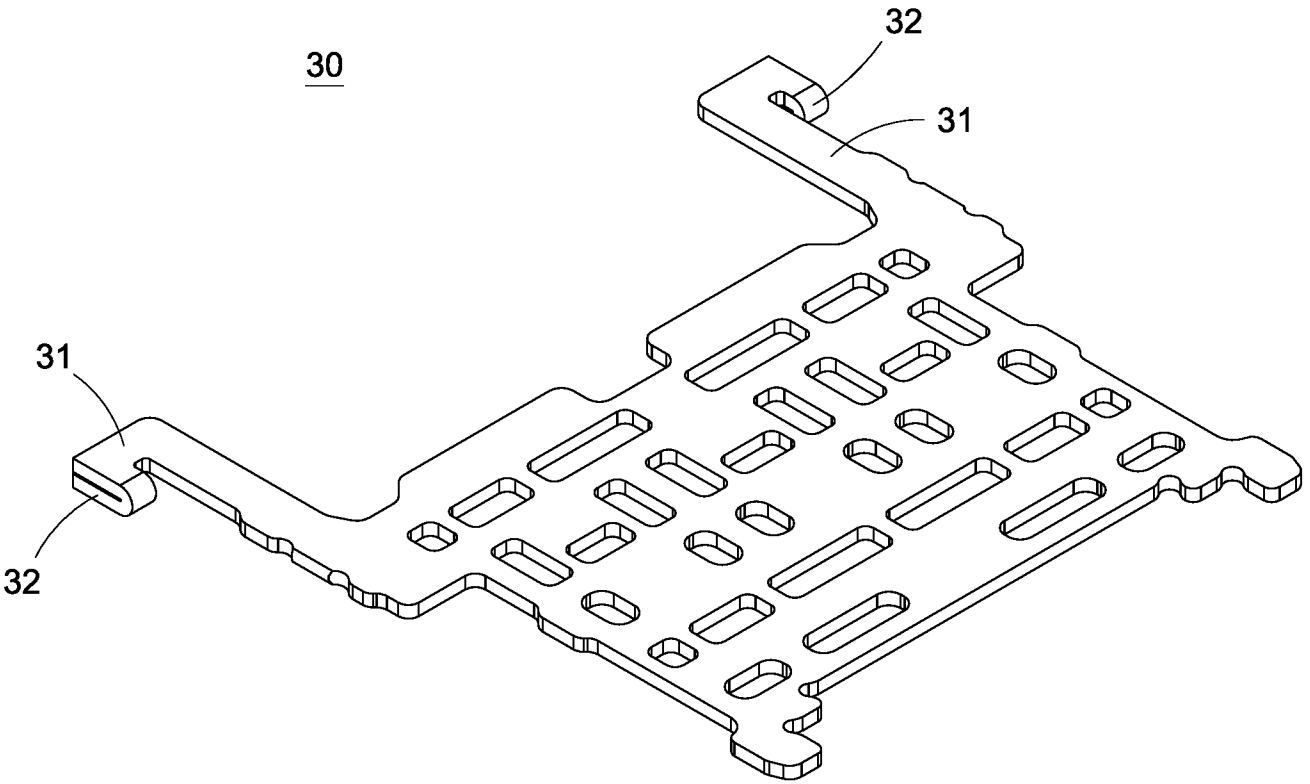
FIG. 3 is a perspective view of the shielding sheet of the disclosure.
Figure 4:
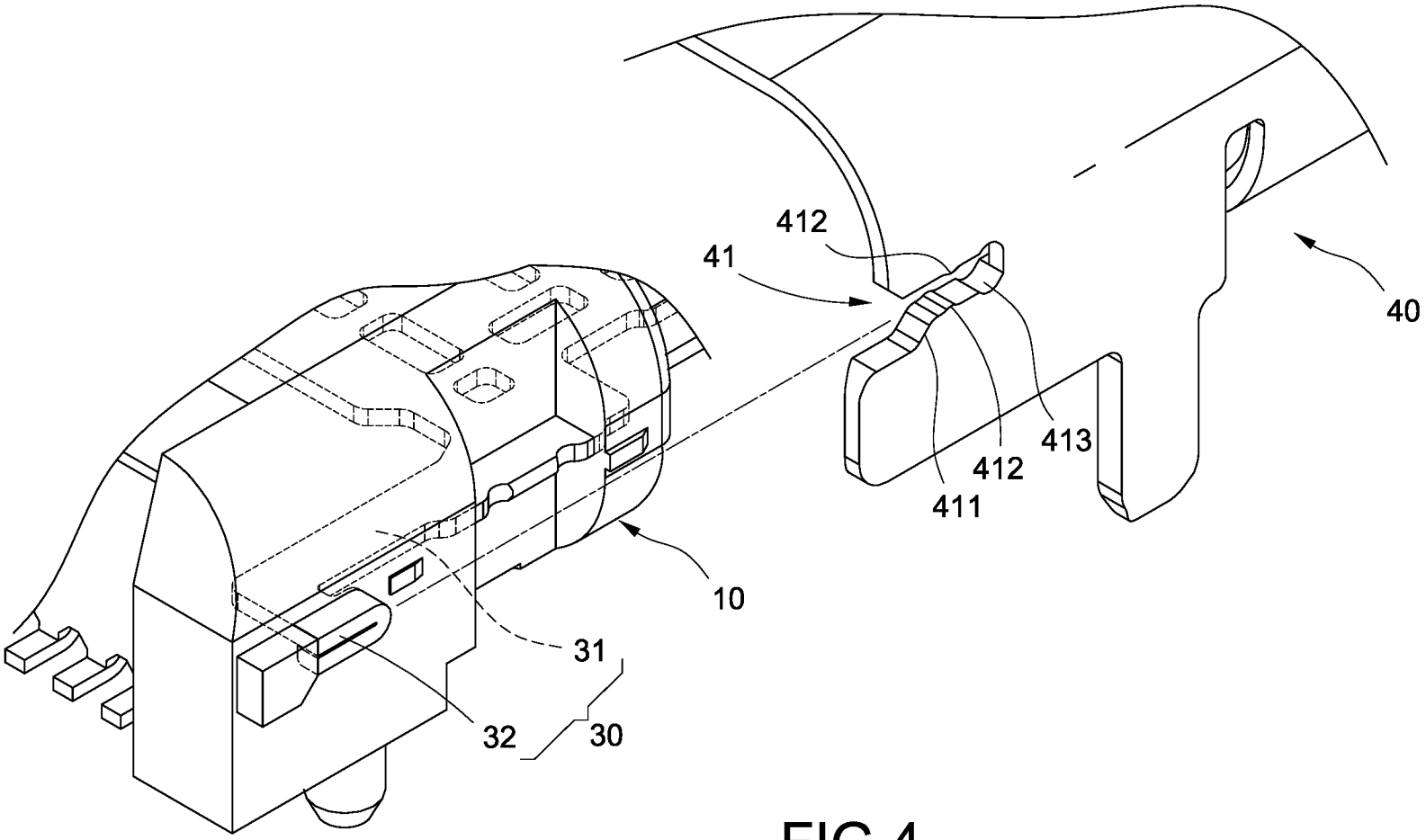
FIG. 4 is a partially exploded view of the disclosure.
Figure 7:
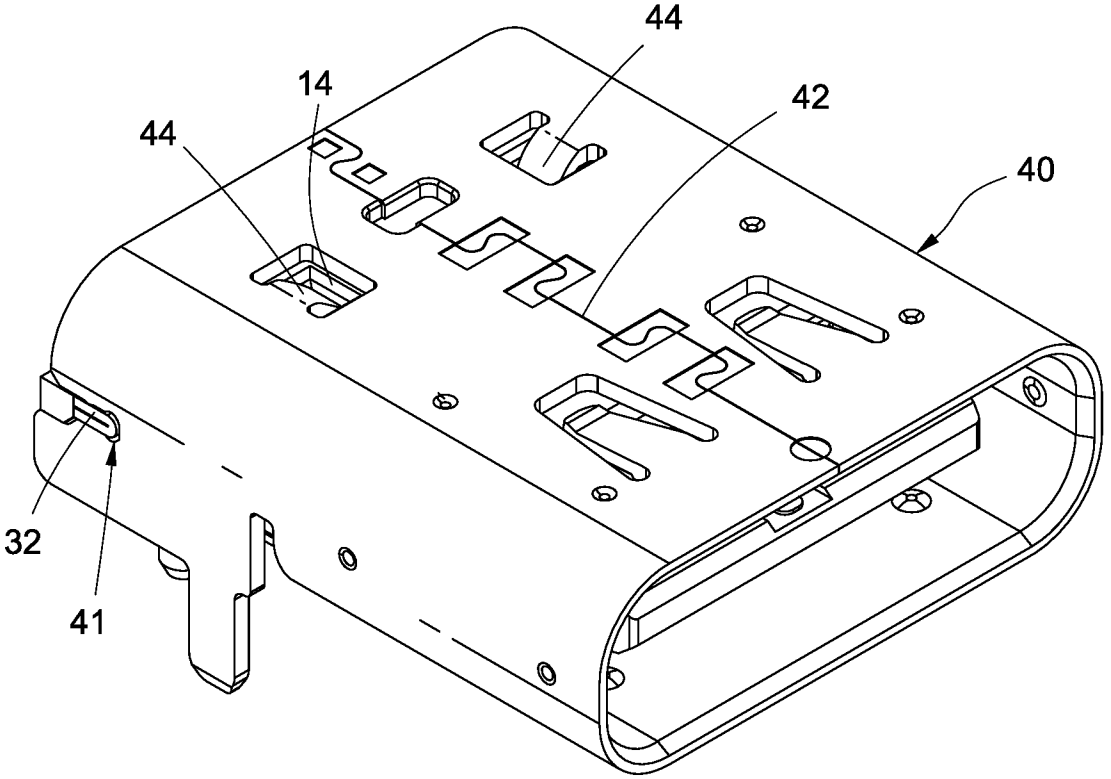
FIGS. 7 and 8 are two perspective views of the disclosure.
Figure 8:
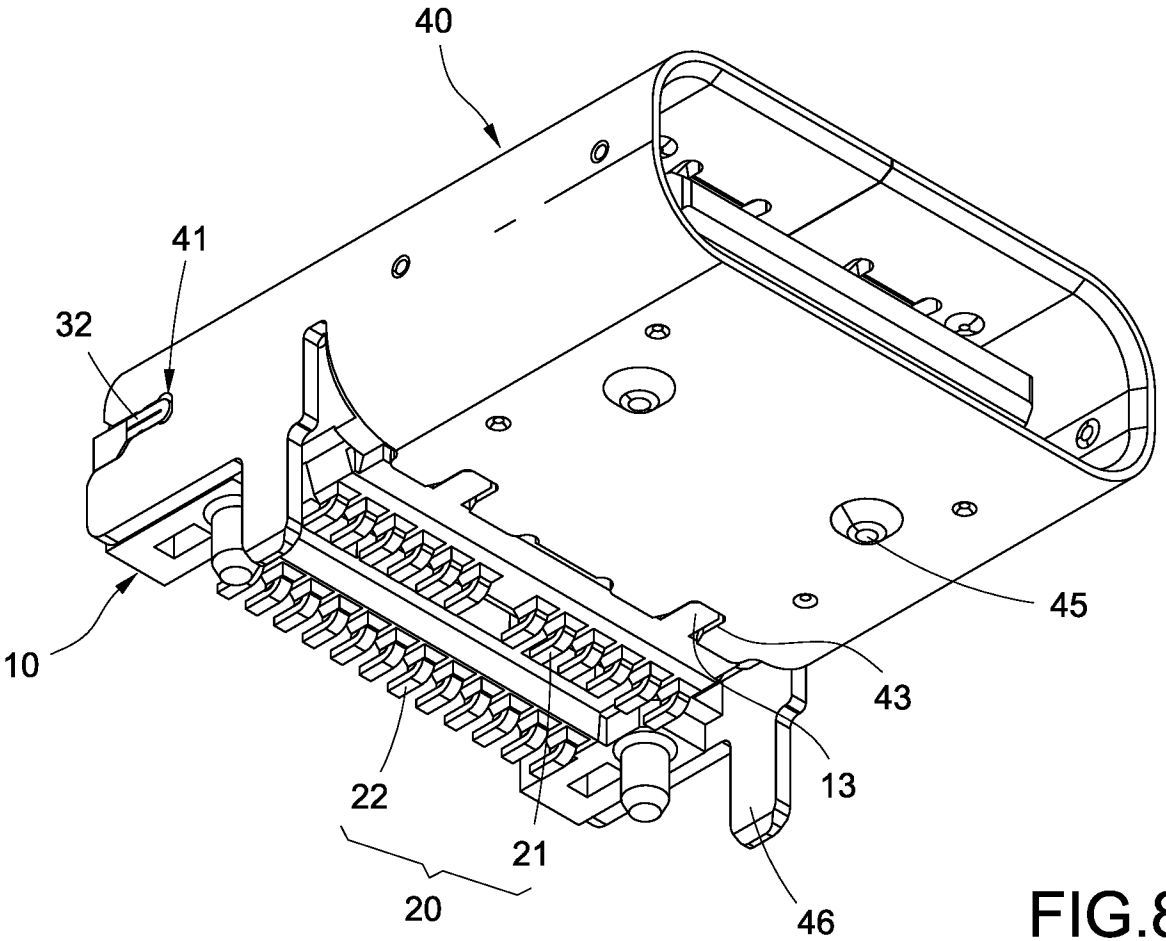

Please refer to FIGS. 2 and 8. The bottom of the insulative body 10 is protruded with multiple positioning blocks 13 toward the extending direction of the tongue 12. The bottom of the shielding shell 40 is formed with multiple positioning troughs 43 respectively corresponding to the positioning blocks 13. Each positioning block 13 is engaged with each positioning trough 43 correspondingly. Thus, when the shielding shell 40 and the insulative body 10 are being assembled, they are installed to the specific position. Please refer to FIGS. 7 and 8, these figures are two perspective views of the shielding shell 40 and the insulative body 10 the disclosure, which are assembled.

Please refer back to FIG. 1. The top of the insulative body 10 is formed with multiple fastening trenches 14. The top of the shielding shell 40 is formed with multiple fastening arms 44. Please further refer to FIG. 7. When the shielding shell 40 is adapted to sheathe the insulative body 10 and the engaging portion 32 engages with the engaging trough 41, each fastening arm 44 may be downward fastened with each fastening trench 14 to further fix the shielding shell 40 to avoid the shielding shell being separated from the insulative body 10.

Figure 9:
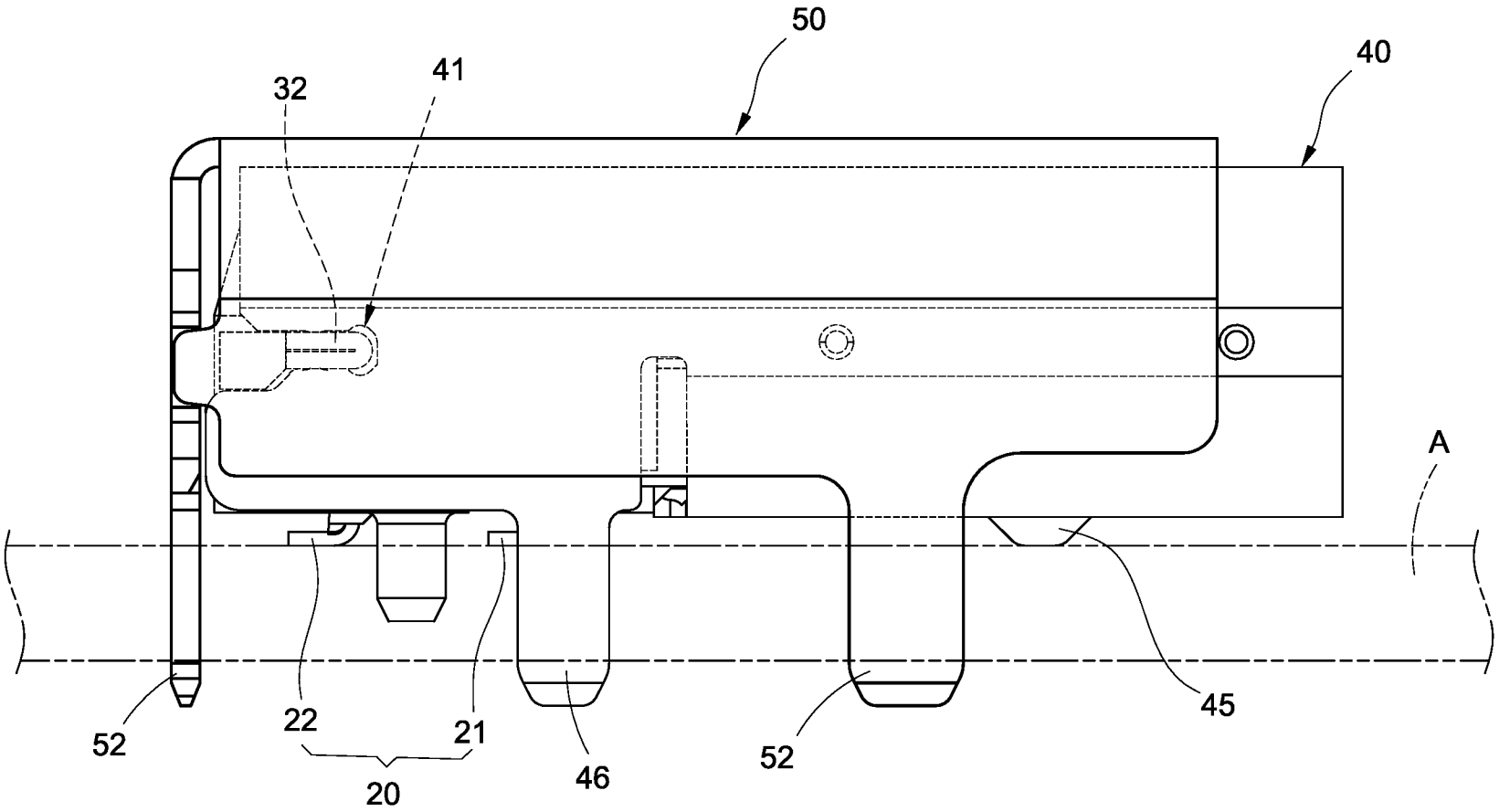
FIG. 9 is a schematic view of the disclosure applied to a printed circuit board.

Please refer to FIGS. 2, 6 and 8. The bottom of the shielding shell 40 is further formed with multiple support protrusions 45. Each support protrusion 45 is approximately of a circular protrusion. It is formed by stretching the metal sheet before the metal sheet is bent to form the shell. Please refer back to FIG. 1. Both the shielding shell 40 and the outer shielding casing 50 are formed with multiple soldering pins 46, 52. Please refer to FIG. 9, which is a schematic view of the disclosure applied to a printed circuit board A. Each soldering pin 46, 52 is inserted into the printed circuit board A for soldering and fixing. Each support protrusion 45 may sustain on the printed circuit board A to prevent the whole electric connector from tilting frontward so as to accomplish a support effect. In comparison with related art, a general design forms a support step at a front of a soldering pin to avoid tilting when the soldering pins are soldered on the printed circuit board. However, different printed circuit boards have different coating thickness, so the electric connector is being raised or tilted in related-art design. The support protrusions of the disclosure may effectively improve this drawback to accomplish the effect of being applied to various printed circuit boards.

While this disclosure has been described by means of specific embodiments, numerous modifications and variations could be made thereto by those skilled in the art without departing from the scope and spirit of this disclosure set forth in the claims.

What is claimed is:

1. An electric connector structure, comprising:

an insulative body, comprising a base and a tongue extended from the base;

multiple conductive terminals, comprising an upper row of terminals and a lower row of terminals, and the upper row of terminals and the lower row of terminals disposed on an upper side and a lower side of the tongue, respectively;

a shielding sheet, embedded in the insulative body, located between the upper row of terminals and the lower row of terminals, an extending section extended respectively from two sides of the shielding sheet and passing through the insulative body, and an engaging portion folded reversely on a distal end of each extending section; and a shielding shell, adapted to sheathe the insulative body, an engaging trough disposed respectively on two sides of the shielding shell, and each of the engaging troughs adapted to sheathe and engage with each of the engaging portions to make the shielding shell contact with the shielding sheet.

2. The electric connector structure of claim 1, wherein multiple protrusions are disposed inside each engaging trough, and each protrusion interferes with the engaging portion.

3. The electric connector structure of claim 1, wherein multiple guiding slants are disposed on each engaging trough.

4. The electric connector structure of claim 1, wherein a recess is disposed inside each engaging trough, and a front of the engaging portion is located in the recess.

5. The electric connector structure of claim 1, wherein multiple support protrusions are disposed on a bottom of the shielding shell.

6. The electric connector structure of claim 5, wherein each support protrusion is a circular protrusion.

7. The electric connector structure of claim 1, wherein the shielding shell comprises a junction located above the tongue.

8. The electric connector structure of claim 7, further comprising: an outer shielding casing, covering the shielding shell to shield the junction.

9. The electric connector structure of claim 8, wherein the outer shielding casing comprises a rear cover bent therefrom and shielding an end of the insulative body away from the tongue.

10. The electric connector structure of claim 1, wherein multiple fastening trench are disposed on the insulative body, multiple fastening arms are disposed on the shielding, and each fastening arm is fastened with each fastening trench.

* * * * *